US010333195B2

(12) United States Patent
Takahashi et al.

(10) Patent No.: US 10,333,195 B2
(45) Date of Patent: Jun. 25, 2019

(54) ELECTRONIC DEVICE

(71) Applicant: Toshiba Client Solutions CO., LTD., Koto-ku, Tokyo (JP)

(72) Inventors: Issei Takahashi, Ome Tokyo (JP); Shigeo Hayashi, Hamura Tokyo (JP)

(73) Assignee: Toshiba Client Solutions CO., LTD., Tokyo (JP)

( * ) Notice: Subject to any disclaimer, the term of this patent is extended or adjusted under 35 U.S.C. 154(b) by 397 days.

(21) Appl. No.: 15/051,464

(22) Filed: Feb. 23, 2016

(65) Prior Publication Data

US 2017/0062899 A1 Mar. 2, 2017

(30) Foreign Application Priority Data

Aug. 27, 2015 (JP) ..... 2015-167934

(51) Int. Cl.
*H01Q 1/02* (2006.01)
*H01Q 1/22* (2006.01)

(52) U.S. Cl.
CPC ..... *H01Q 1/02* (2013.01); *H01Q 1/2266* (2013.01); *H01Q 1/2291* (2013.01)

(58) Field of Classification Search
CPC ..... H01Q 1/02; H01Q 1/24
See application file for complete search history.

(56) References Cited

U.S. PATENT DOCUMENTS 9,618,691 B2 * 4/2017 Yokawa ..... G02B 6/0088
2009/0239130 A1 * 9/2009 Culver ..... H01M 2/206 429/50
2011/0279331 A1 * 11/2011 Mattis ..... H01Q 1/02 343/702
2015/0316966 A1 * 11/2015 Chen ..... G06F 1/1658 361/679.47
2016/0064814 A1 * 3/2016 Jang ..... H01Q 1/526 343/842
2018/0205131 A1 * 7/2018 Hwang ..... H01Q 1/02

FOREIGN PATENT DOCUMENTS

JP 2007-318210 A 12/2007
JP 2008-227362 A 9/2008
JP 2010-102610 A 5/2010

* cited by examiner

*Primary Examiner* — Dameon E Levi
*Assistant Examiner* — David E Lotter
(74) *Attorney, Agent, or Firm* — Knobbe, Martens, Olson & Bear, LLP

(57) ABSTRACT

According to one embodiment, an electronic device includes a housing, an antenna, and a sheet metal member. The antenna is contained in the housing with a gap formed between the antenna and the housing. The sheet metal member is supporting the antenna to be thermally connected with the antenna.

9 Claims, 8 Drawing Sheets

ELECTRONIC DEVICE

CROSS-REFERENCE TO RELATED APPLICATIONS

This application is based upon and claims the benefit of priority from Japanese Patent Application No. 2015-167934, filed Aug. 27, 2015, the entire contents of which are incorporated herein by reference.

FIELD

Embodiments described herein relate generally to an electronic device comprising an antenna.

BACKGROUND

An electronic device comprising an antenna inside a housing is well known. The antenna is in contact with an inner surface of the housing.

When heat is generated at the antenna during operations, the heat of the antenna is directly transferred to the housing and a surface of the housing may be locally heated at a high temperature. If a heat radiating member is additionally provided to suppress the rise in temperature on the local surface of the housing, space for containing the heat radiating member needs to be secured in the housing. Therefore, the mounting space is increased and space in the housing is reduced.

BRIEF DESCRIPTION OF THE DRAWINGS

A general architecture that implements the various features of the embodiments will now be described with reference to the drawings. The drawings and the associated descriptions are provided to illustrate the embodiments and not to limit the scope of the invention.

DETAILED DESCRIPTION

Various embodiments will be described hereinafter with reference to the accompanying drawings.

In general, according to one embodiment, an electronic device includes a housing, an antenna, and a sheet metal member. The antenna is contained in the housing with a gap formed between the antenna and the housing. The sheet metal member is supporting the antenna to be thermally connected with the antenna.

An electronic device of a first embodiment will be explained hereinafter with reference to FIG. 1 to FIG. 8. In the present embodiment, a tablet PC will be explained as an example of the electronic device. The electronic device is not limited to the tablet PC, but may be the other electronic device such as a television receiver or a digital signage.

As shown in FIG. 1 to FIG. 4, an electronic device 1 comprises a housing 2, and a display panel 3 and an antenna 4 which are contained in the housing 2.

The display panel 3 is shaped in a rectangular flat plate, and comprises a display surface 3A on which information such as a character and an image is displayed and a back surface 3B located on a side opposite to the display surface 3A.

The antenna 4 is arranged in close vicinity to an edge portion of the display panel 3. The antenna 4 used to, for example, high-speed transmission standards such as WiGig and WirelessHD, and the antenna itself generates heat during the operation. The temperature of the antenna 4 of the present embodiment is often raised to, for example, 80° C. and the generated heat amount is larger than that of a conventional antenna.

Figure 1:
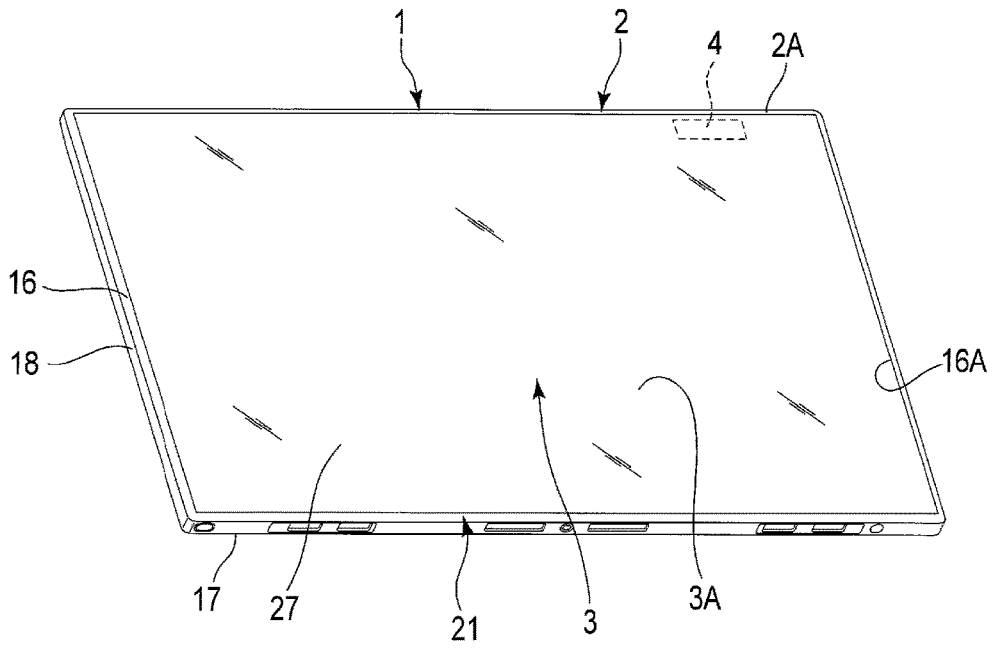
FIG. 1 is a perspective view showing an electronic device of a first embodiment.
Figure 2:
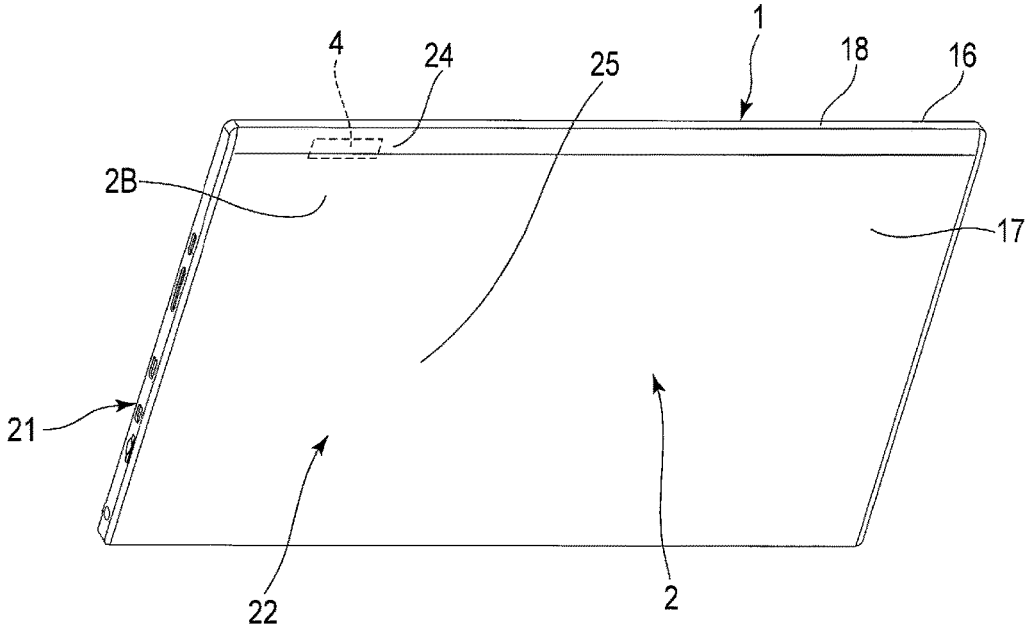
FIG. 2 is a perspective view of the electronic device shown in FIG. 1 seen from a cover side.

As shown in FIG. 1 and FIG. 2, the housing 2 is formed in a shape of a rectangular flat box, and contains the display panel 3 and the antenna 4. The housing 2 comprises a front wall 16, a back wall 17, and a peripheral wall 18.

The front wall 16 extends on substantially the same plane as the display surface 3A. An outer surface of the front wall 16 is an example of a first surface 2A of the housing 2. The front wall 16 includes a rectangular opening portion 16A which exposes the display surface 3A of the display panel 3. The back wall 17 extends parallel to the front wall 16. An outer surface of the back wall 17 is an example of a second surface 2B of the housing 2. The peripheral wall 18 connects an edge portion of the front wall 16 and an edge portion of the back wall 17.

In the example shown in FIG. 1 and FIG. 2, the housing 2 is composed of a combination of a mask 21 and a cover 22. The mask 21 includes the front wall 16 while the cover 22 includes the back wall 17.

The cover 22 comprises an antenna cover 24 and a cover body 25. The antenna cover 24 is formed of, for example, a synthetic resin material. The antenna cover 24 is provided at a position opposed to the antenna 4.

The cover body 25 is a portion of the cover 22 excluding the antenna cover 24. The cover body 25 is formed of, for example, a magnesium alloy. The material of the cover body 25 is not limited to a magnesium alloy, but the cover body 25 may also be formed of, for example, a synthetic resin material. In this case, the antenna cover 24 and the cover body 25 can be formed as an integrated structure.

It should be noted that the electronic device 1 may further comprise a transparent glass panel 27. The glass panel 27 shown in FIG. 1 seals the opening portion 16A of the mask 21 and protects the display surface 3A of the display panel 3.

Figure 3:
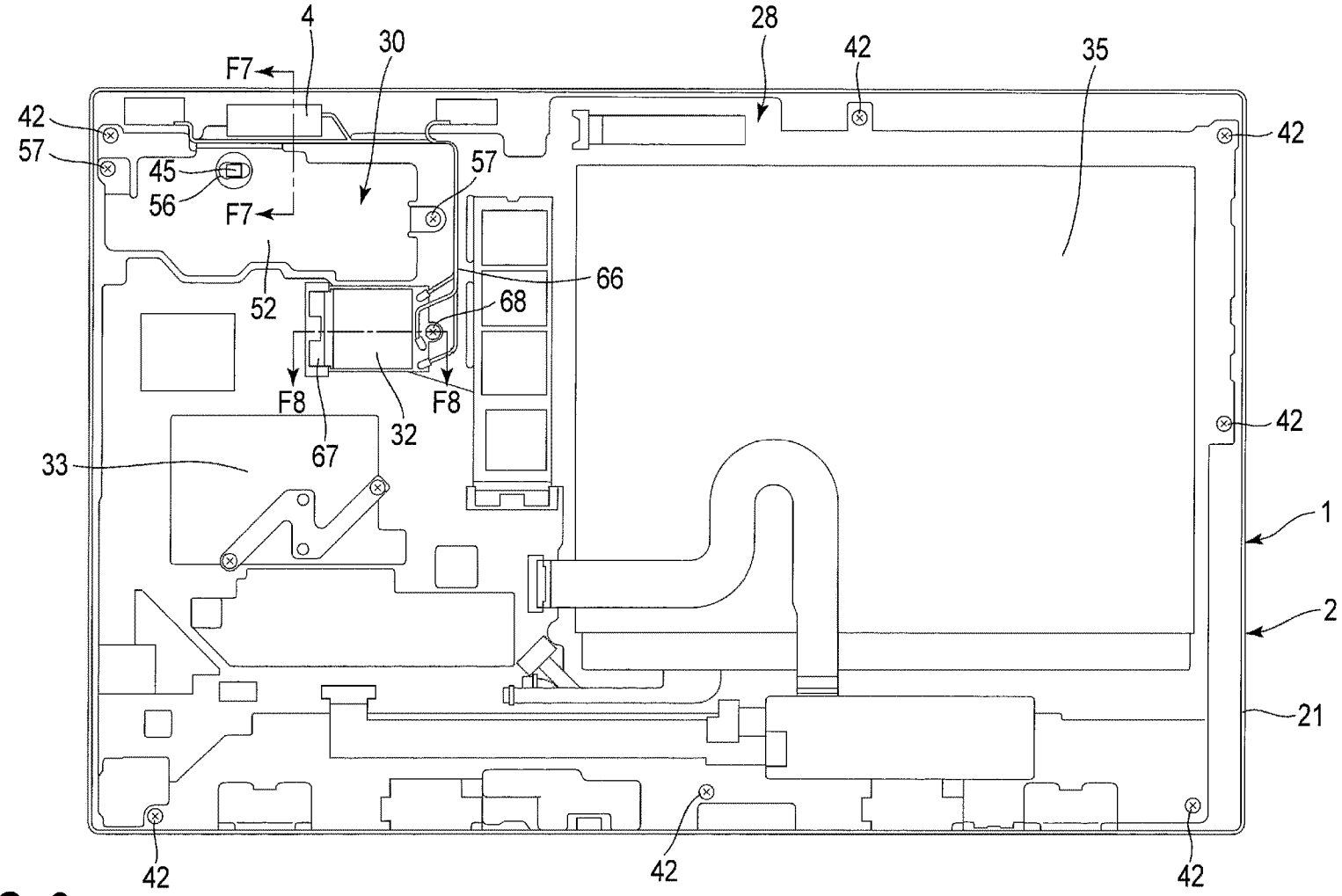
FIG. 3 is a plan view showing an inside of the electronic device with the cover shown in FIG. 2 removed.

FIG. 3 is a plan view showing an inside of the electronic device 1 with the cover 22 removed. Besides the display panel 3 and the antenna 4, the housing 2 contains a middle frame 28 which covers the back surface 3B of the display panel 3, a sheet metal member 30 fixed to the middle frame 28, a wireless module 32, a plurality of chip sets 33, a battery pack, etc.

The chip sets 33 are, for example, elements which control the operations of the display panel 3, etc., and supply the power of the battery pack 35 to the display panel 3, etc.

Figure 4:
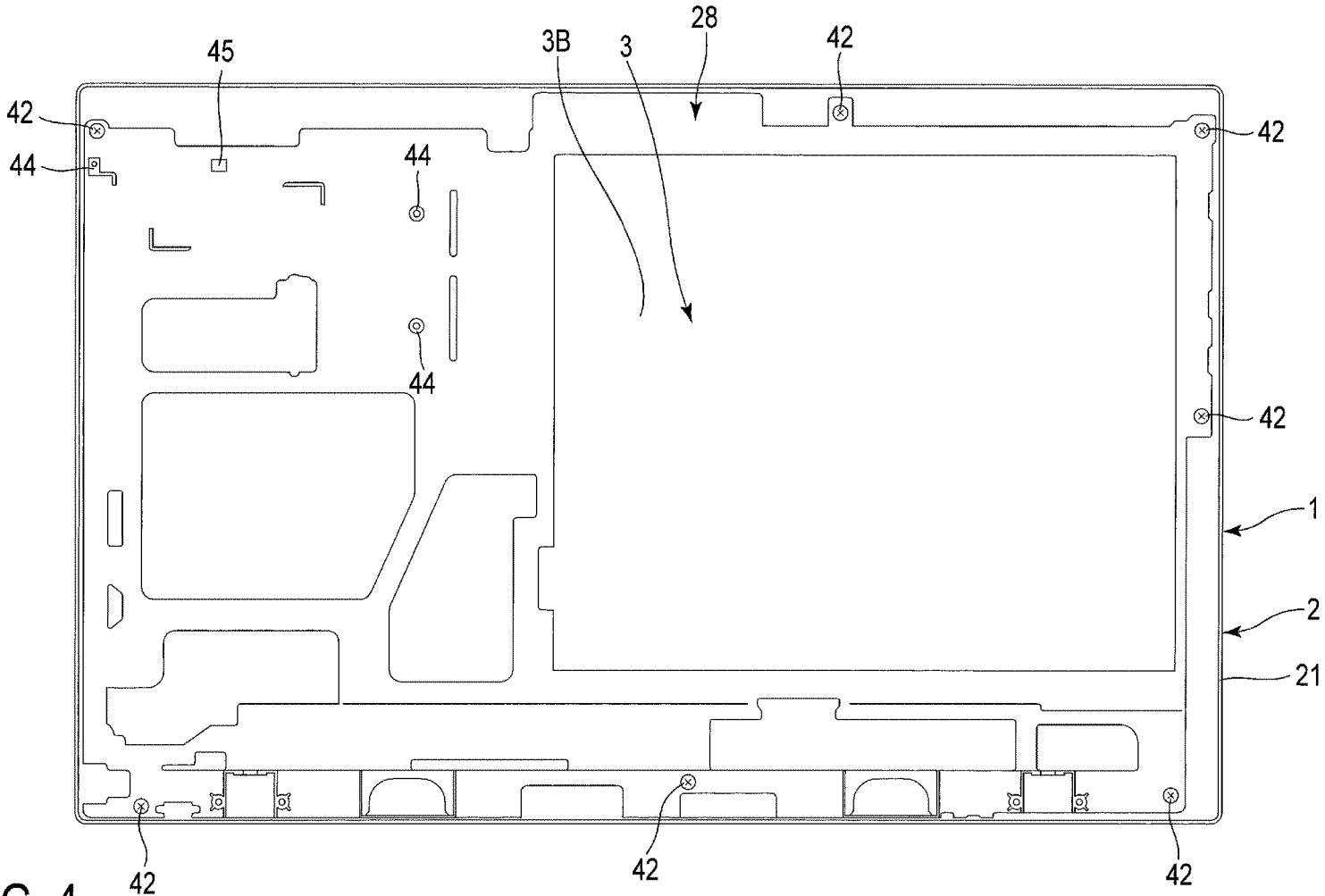
FIG. 4 is a plan view showing a state of containing a middle frame in a housing.

FIG. 4 is a plan view showing the electronic device 1 having the sheet metal 30, etc., removed and the middle frame 28 exposed.

The middle frame 28 is formed in a rectangular shape smaller than the mask 21 of the housing 2, and has a heat capacity larger than the sheet metal member 30. The middle frame 28 is fixed to the mask 21 by a plurality of fastening portions 42. A plurality of screw holes 44 and bosses 45 for positioning are provided on the middle frame 28.

The middle frame 28 is formed of, for example, a magnesium alloy. If the middle frame 28 is formed of a magnesium alloy, a thermal conductivity is in a range of, for example, 40 to 150 W/(m·K). The middle frame 28 can be formed of not only a magnesium alloy, but, for example, aluminum or a synthetic resin material.

Figure 5:
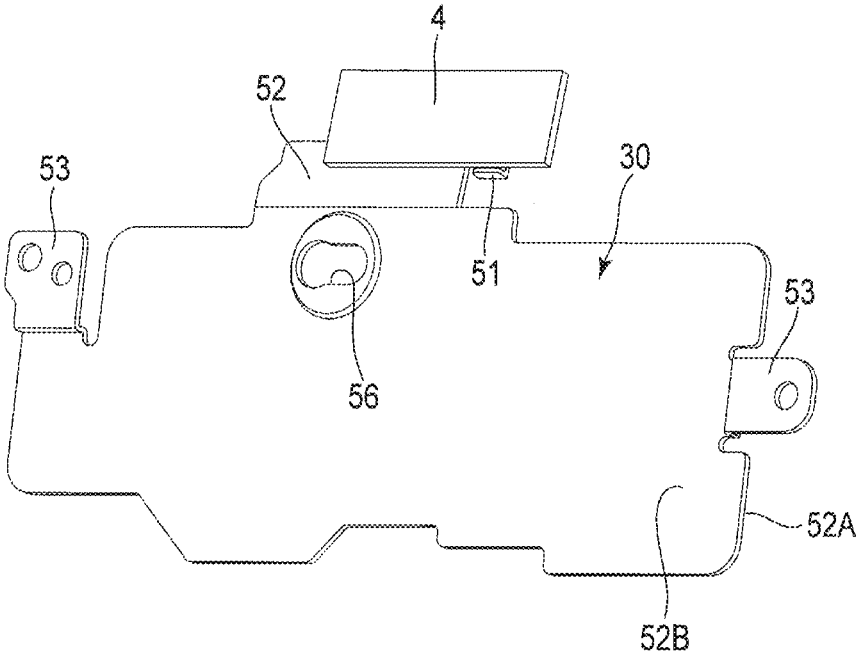
FIG. 5 is a perspective view showing a state of fixing an antenna on a sheet metal member used in the first embodiment.

FIG. 5 is a perspective view of the sheet metal member 30. The sheet metal member 30 is formed of a material having a higher thermal conductivity than the middle frame 28. The material of the sheet metal member 30 is, for example, copper, a copper alloy or a graphite sheet. When the material of the sheet metal member 30 is copper or a copper alloy, a thermal conductivity is in a range of, for example, 200 to 400 W/(m·K). In the example shown in FIG. 5, the sheet metal member 30 is formed of copper.

The sheet metal member 30 comprises an antenna support portion 51, a heat diffusion portion 52 continuous to the antenna support portion 51, and a pair of fixing portions 53 provided at the heat diffusion portion 52. The antenna support portion 51 is an element which supports the antenna 4, and has, for example, substantially the same size as the antenna 4. The heat diffusion portion 52 is formed to be larger than the antenna support portion 51. The heat diffusion portion 52 includes a first surface 52A located on the side of the first surface 2A of the housing 2, and a second surface 52B located on an opposite side to the first surface 52A.

The fixing portions 53 are provided at positions remote from the antenna 4. In the example shown in FIG. 5, a fitting hole 56 is provided on the heat diffusion portion 52. As shown in FIG. 3, the fixing portions 53 are fixed to the screw holes 44 of the middle frame 28 by screws 57. A boss 45 of the middle frame 28 is inserted into the fitting hole 56.

Figure 6:
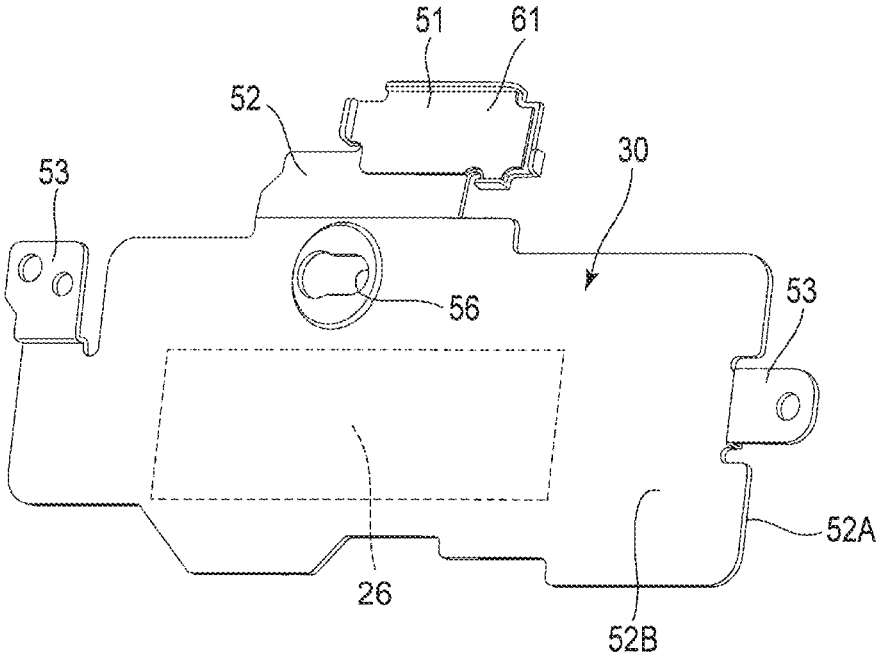
FIG. 6 is a perspective view showing a state of attaching first and second heat transfer members on the sheet metal member.

FIG. 6 is a perspective view of the sheet metal member 30 having the antenna 4 excluded from the antenna support portion 51. A first heat transfer member 61 is adhered to the antenna support portion 51 of the sheet metal member 30. The first heat transfer member 61 is interposed between the antenna 4 and the antenna support portion 51 to make thermal connection between the antenna 4 and the antenna support portion 51 more certainly.

An example of the first heat transfer member 61 is a thermally conductive double-sided tape. The first heat transfer member 61 may be a thermally conductive sheet or thermally conductive grease. If the first heat transfer member 61 is not a thermally conductive double-sided tape, the antenna 4 may be fixed to the antenna support portion 51 by auxiliary means such as a screw.

A second heat transfer member 62 is adhered to the first surface 52A of the heat diffusion portion 52. An example of the second heat transfer member 62 is a thermally conductive sheet. The second heat transfer member 62 is not limited to a thermally conductive sheet, but may also be a thermally conductive double-sided tape or thermally conductive grease.

Figure 7:
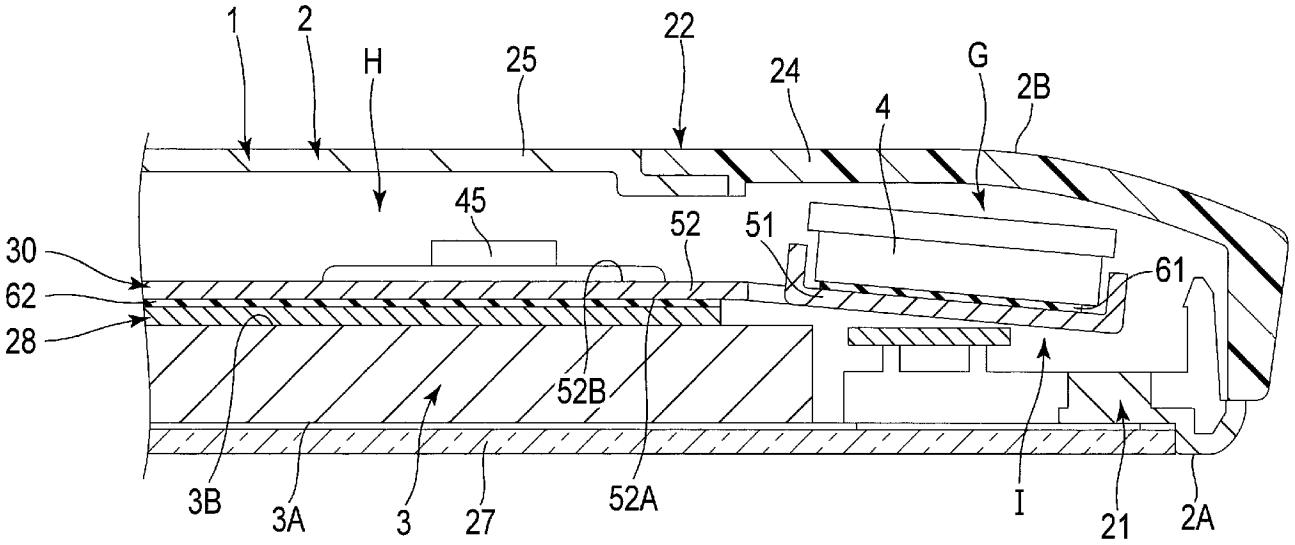
FIG. 7 is a cross-sectional view seen along line F7-F7 in FIG. 3.

FIG. 7 is a cross-sectional view showing the antenna 4 mounted in the antenna support portion 51 of the sheet metal member 30 as seen along line F7-F7 in FIG. 3. As shown in FIG. 7, the second heat transfer member 62 is interposed between the sheet metal member 30 and the middle frame 28 to make thermal connection between the sheet metal member 30 and the middle frame 28 more certainly.

In the first embodiment, a gap G is formed between the antenna cover 24 of the housing 2 and the antenna 4. The gap G has a length of, for example, 0.5 mm.

The antenna 4 executes signal transmission to or reception from the antenna cover 24. No element to disturb the signal transmission/reception is provided in the gap G. An air layer extending the gap G shuts out to prevent the heat of the antenna 4 from transferring to the antenna cover 24.

Furthermore, a gap H is also formed between the cover body 25 of the housing 2 and the heat diffusion portion 52 of the sheet metal member 30. The cover 22 is therefore thermally separated from the sheet metal member 30. In the example shown in FIG. 7, a gap I is also formed between the mask 21 of the housing 2 and the antenna support portion 51 of the sheet metal member 30. The mask 21 is therefore thermally separated from the sheet metal member 30.

Figure 8:
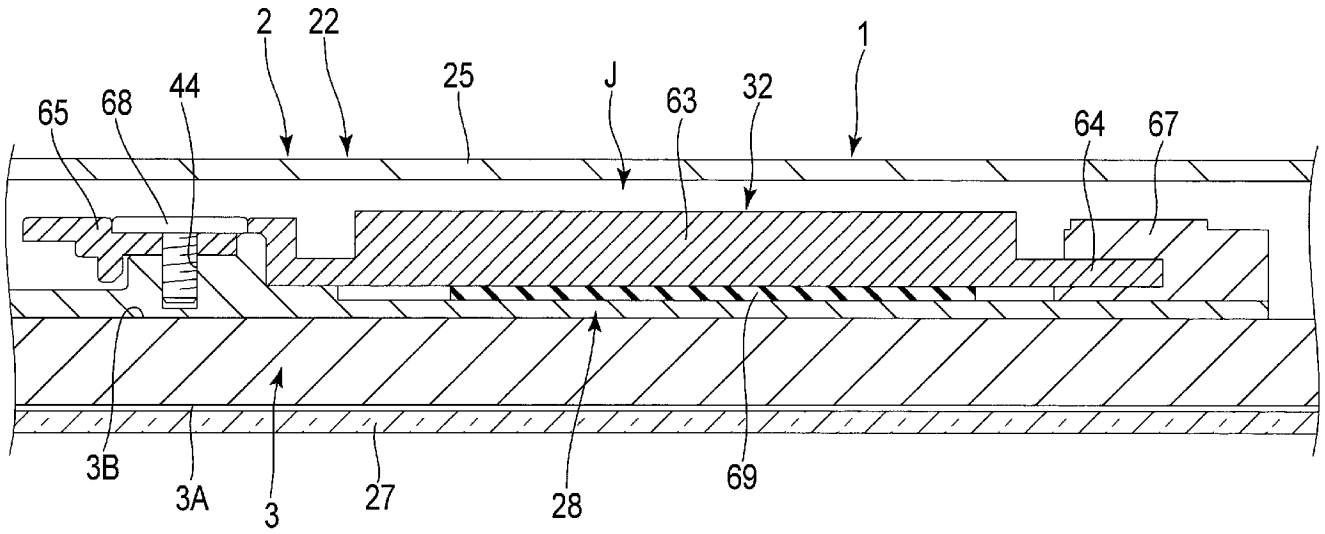
FIG. 8 is a cross-sectional view seen along line F8-F8 in FIG. 3.

FIG. 8 is a cross-sectional view showing the wireless module 32 mounted in the middle frame 28 as seen along line F8-F8 in FIG. 3. In the example shown in FIG. 8, the wireless module 32 comprises a heat generating portion 63, a connecting portion 64 and a fixed portion 65.

The heat generating portion 63 is electrically connected to the antenna 4 via a cable 66 shown in FIG. 3 and generates heat in accordance with the operation of the antenna 4. The connecting portion 64 is provided at one of ends of the heat generating portion 63 and inserted into a connector 67 of the chip set 33. The fixed portions 65 is provided at the other end of the heat generating portion 63 and fixed to the screw hole 44 of the middle frame 28 by a screw 68. A gap J is formed between the cover body 25 of the housing 2 and the wireless module 32.

A third heat transfer member 69 is adhered to the heat generating portion 63 of the wireless module 32. The third heat transfer member 69 is interposed between the sheet metal member 30 and the middle frame 28 to make thermal connection between the wireless module 32 and the middle frame 28.

An example of the third heat transfer member 69 is a thermally conductive sheet. The third heat transfer member 69 is not limited to a thermally conductive sheet, but may also be a thermally conductive double-sided tape or thermally conductive grease.

In the electronic device 1 of the present embodiment configured as explained above, direct transfer of the heat generated at the antenna 4 to the housing 2 can be suppressed since the gap G is formed between the antenna 4 and the antenna cover 24 of the housing 2. Since the antenna 4 is thermally connected to the sheet metal member 30, the heat generated by the antenna 4 can be dissipated and diffused to the sheet metal member 30 inside the housing 2. For this reason, even if the communication speed becomes higher and the amount of the heat generation at the antenna 4 is increased, rise in temperature on a local surface of the housing 2 can be suppressed.

Furthermore, the sheet metal member 30 comprises both the function of supporting the antenna 4 and the function of diffusing the heat of the antenna 4. For this reason, a space for mounting the antenna 4 can be compacted as compared with a case of providing the support member which supports the antenna and the heat radiating member which radiates the heat of the antenna, separately, on the housing 2.

In the present embodiment, the thermal connection between the antenna 4 and the antenna support portion 51 is more strengthened due to the presence of the first heat transfer member 61. For this reason, the heat of the antenna 4 can be certainly dissipated to the sheet metal member 30.

In the present embodiment, the antenna 4 executes signal transmission to or reception from the antenna cover 24 of the housing 2. The gap G extends between the antenna 4 and the antenna cover 24 in a direction of executing communication by the antenna 4. For this reason, communication of the antenna 4 is not disturbed inside the housing 2.

In the present embodiment, the sheet metal member 30 is fixed to the middle frame 28 having a larger heat capacity than the sheet metal member 30. For this reason, the heat transferred from the antenna 4 to the sheet metal member 30 can be efficiently dissipated and diffused to the middle frame 28.

Furthermore, in the present embodiment, the thermal connection between the sheet metal member 30 and the middle frame 28 is more strengthened due to the presence of the second heat transfer member 62. For this reason, the heat of the antenna 4 transferred to the sheet metal member 30 can be certainly dissipated to the middle frame 28.

In addition, the heat of the wireless module 32 can be efficiently transferred to the middle frame 28 due to the presence of the third heat transfer member 69. As a result, the operation of the wireless module 32 can be made stable and the reliability of communication of the antenna 4 can be increased.

It can be explained from the other viewpoint that the antenna 4 is thermally separated from the housing 2, in the electronic device 1 of the present embodiment. Since the antenna support portion 51 of the sheet metal member 30 supporting the antenna 4 is sequential with the heat diffusion portion 52 of the sheet metal member 30, the heat generated by the antenna 4 can be dissipated and diffused from the antenna support portion 51 to the heat diffusion portion 52. As a result, even if the communication speed becomes higher and the amount of the heat generation at the antenna 4 is increased, rise in temperature on a local surface of the housing 2 can be suppressed.

Moreover, in the present embodiment, the heat diffusion portion 52 of the sheet metal member 30 is fixed to the middle frame 28. Thus, the heat transferred from the antenna 4 to the antenna support portion 51 can be diffused to the heat diffusion portion 52 and then dissipated to the middle frame 28, and rise in temperature on a part of the middle frame 28 can be suppressed.

In other words, the heat generated at the antenna 4 is diffused to the sheet metal member 30 formed of a material having a high thermal conductivity and then dissipated to the middle frame 28. For this reason, the heat from the antenna 4 can be diffused to the middle frame 28 in a wider area as compared with a case where the antenna 4 is directly supported by the middle frame 28. As a result, the heat radiation property of the antenna 4 can be further increased.

In the present embodiment, the heat diffusion portion 52 is larger in size than the antenna support portion 51, and secures sufficient heat capacity and heat radiation property. For this reason, rise in temperature on a local surface of the housing 2 can be suppressed more certainly.

Second Embodiment

An electronic device 100 of a second embodiment will be explained hereinafter with reference to FIG. 9 and FIG. 10. The electronic device 100 of the second embodiment is a clamshell notebook PC.

Figure 9:
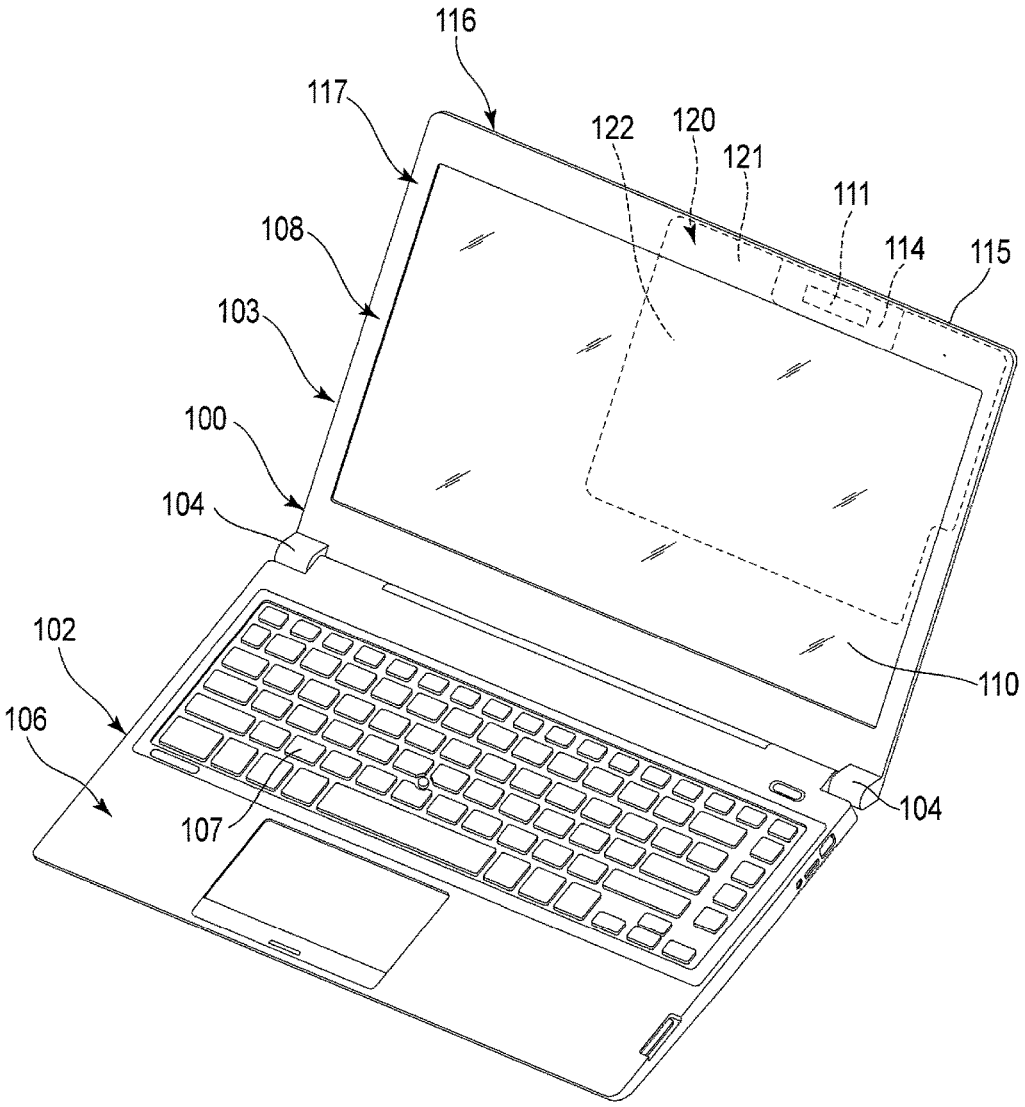
FIG. 9 is a perspective view showing an electronic device of a second embodiment.

As shown in FIG. 9, the electronic device 100 comprises a PC body 102, a display 103, and a pair of hinges 104 that couple the PC body 102 and the display 103. The PC body 102 comprises a first housing 106, a keyboard 107 provided on the first housing 106, etc.

The display 103 comprises a second housing 108, and a display panel 110 and an antenna 111 which are contained in the second housing 108. The antenna 111 is located on an opposite side to the hinge 104, in the second housing 108.

The second housing 108 is constituted by a combination of a cover 116 which includes an antenna cover 114 and a cover body 115, and a mask 117. The antenna cover 114 is provided at a position opposed to the antenna 111 in a thickness direction of the second housing 108. The antenna cover 114 and the antenna 4 are provided remote from each other so as to be thermally separated from each other.

Figure 10:
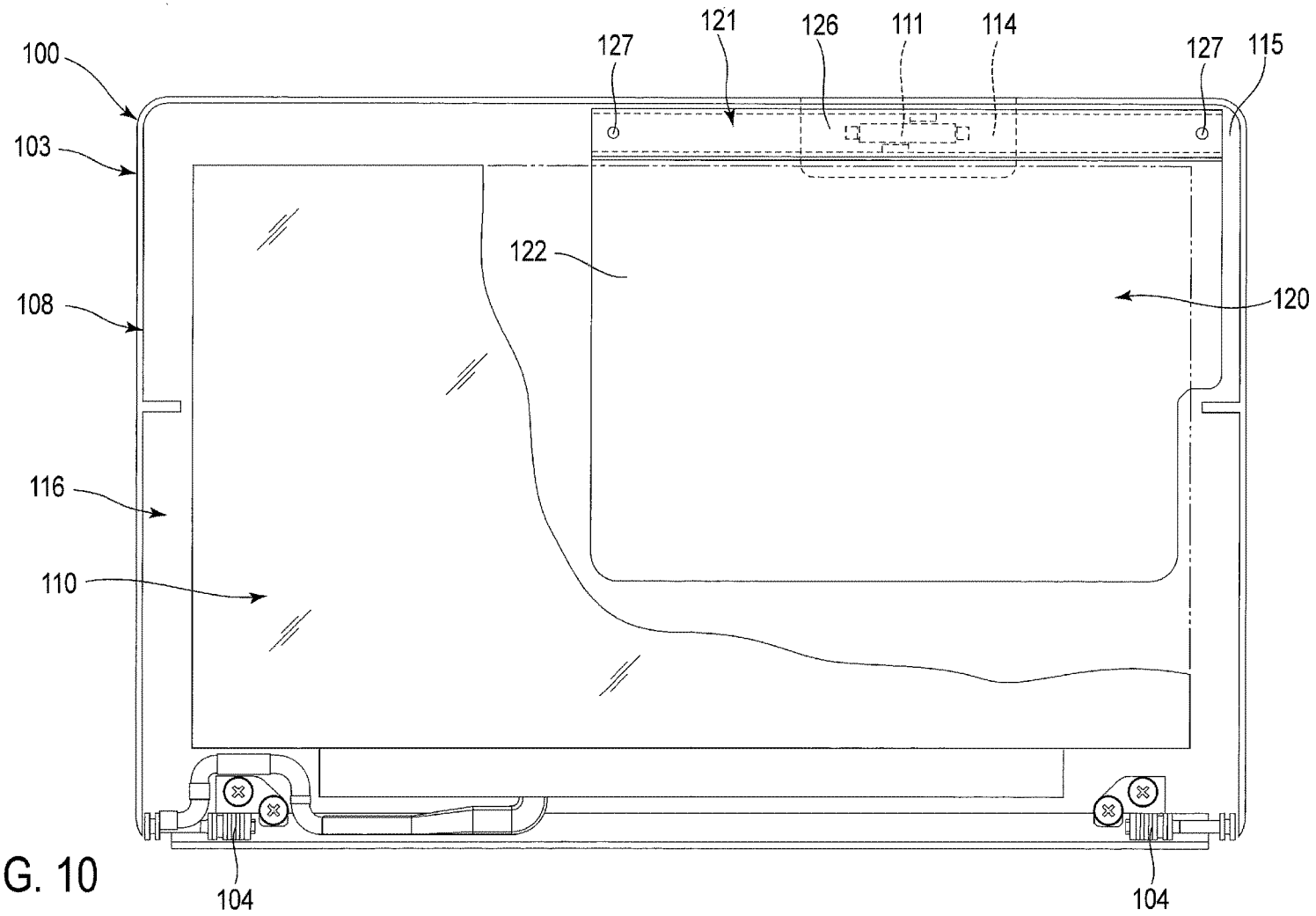
FIG. 10 is a front view showing a state of containing the sheet metal member fixed on the antenna in a second housing.

FIG. 10 is a front view of the display 103 with the mask 21 and the display panel 3 cut away in part. In the second embodiment, the display 103 does not comprise a middle frame. A sheet metal member 120 is directly fixed to the cover body 115 of the second housing 108.

The sheet metal member 120 shown in FIG. 10 is formed to be thinner than the sheet metal member of the first embodiment. The sheet metal member 120 comprises a multilayered portion 121 formed by folding and stacking a sheet metal material, and a heat diffusion portion 122 continuous to the multilayered portion 121. The multilayered portion 121 is thicker and stronger than the heat diffusion portion 122 which is not formed by folding and stacking a sheet metal material. The multilayered portion 121 is arranged outside the display panel 110 to extend along an edge of the display panel 110.

The multilayered portion 121 comprises an antenna support portion 126 which supports the antenna 111, and a pair of fixing portions 127 provided remote from the antenna support portion 126. In the example shown in FIG. 10, the fixing portions 127 are fixed to the cover body 115 of the cover 116.

The heat diffusion portion 122 is formed to be thinner and larger than the antenna support portion 126, and extends along an inner surface of the cover body 115.

In the second embodiment constituted as explained, the heat generated at the antenna 111 can be dissipated and diffused to the heat diffusion portion 122, similarly to the first embodiment. For this reason, even if the communication speed becomes higher and the amount of the heat generation at the antenna 111 is increased, rise in temperature on a local surface of the second housing 108 can be suppressed.

Furthermore, in the second embodiment, the second housing 108 can be made further thinner since the middle frame of the first embodiment can be omitted.

In addition, the heat of the antenna 111 can be smoothly diffused by the greatly extending heat diffusion portion 122. Furthermore, the heat diffusion portion 122 can be made thinner and the second housing 108 can be thinned. In contrast, the antenna 111 can be certainly supported since the antenna support portion 126 is provided on the multilayered portion 121 which is formed to be thicker than the heat diffusion portion 122. Since the multilayered portion 121 is formed to be thick but arranged at a position displaced from the display panel 3, the second housing 108 can be maintained in a thin form.

Some embodiments of the present invention have been described, but these embodiments are presented as examples, and are not intended to limit the scope of the invention. These novel embodiments can be carried out in various other forms, and can be omitted, replaced and changed in a variety of ways without departing from the spirit of the invention. These embodiments and modifications thereof are included in the claims and spirit of the invention, and also included in the inventions described in the claims and their equivalents. For example, the antenna and the sheet metal member may be contained not in the second housing, but in the first housing, in the second embodiment. If the antenna and the sheet metal member are contained in the first housing, the display may be removed from the electronic device 1.

What is claimed is:

1. An electronic device comprising:

a housing;

a display panel in the housing;

an antenna in close vicinity to an edge portion of the display panel in the housing;

a sheet metal member comprising an antenna support portion configured to support the antenna and a heat diffusion portion provided sequentially with the antenna support portion, the heat diffusion portion configured to diffuse heat generated by the antenna;

a first heat transfer member between the antenna and the antenna support portion, the first heat transfer member configured to transfer the heat generated by the antenna to the heat diffusion portion;

an antenna cover provided via a gap formed at a position opposed to the antenna separately from a cover body of the housing; and a middle frame accommodated in the housing and covering a part of a back surface of the display panel, wherein the heat diffusion portion of the sheet metal member is fixed to the middle frame, and the antenna transmits a signal to the antenna cover on a side opposite to a display surface of the display panel.

2. The electronic device of claim 1, wherein the gap is formed between the antenna and the antenna cover to prevent the heat generated by the antenna from transferring to the antenna cover.

3. The electronic device of claim 2, further comprising a second heat transfer member between the heat diffusion portion of the sheet metal member and the middle frame.

4. The electronic device of claim 3, further comprising:

a wireless module fixed to a side closer to the second surface of the middle frame and electrically connected with the antenna; and a third heat transfer member between the wireless module and the middle frame, wherein a second space is formed between the wireless module and the cover body of the second surface.

5. The electronic device of claim 2, wherein the sheet metal member is formed of a material having a higher thermal conductivity than the middle fame.

6. The electronic device of claim 1, wherein the heat diffusion portion is formed to be larger than the antenna support portion.

7. The electronic device of claim 2, wherein the heat diffusion portion of the sheet metal member is provided with a fixing portion fixed to the middle frame housing.

8. The electronic device of claim 3, wherein a third space is formed between the heat diffusion portion of the sheet metal member and the cover body of the second surface, and a fourth space is formed between the antenna support portion of the sheet metal member and the first surface.

9. The electronic device of claim 1, wherein the middle frame has a heat capacity larger than the sheet metal member.

* * * * *